United States Patent [19]

Hirano

[11] Patent Number: 4,522,916

[45] Date of Patent: Jun. 11, 1985

[54] SILVER HALIDE COLOR PHOTOGRAPHIC LIGHT-SENSITIVE MATERIAL

[75] Inventor: Tsumoru Hirano, Kanagawa, Japan

[73] Assignee: Fuji Photo Film Co., Ltd., Kanagawa, Japan

[21] Appl. No.: 643,928

[22] Filed: Aug. 24, 1984

[30] Foreign Application Priority Data

Aug. 24, 1983 [JP] Japan ..... 58-154484

[51] Int. Cl.[3] ..... G03C 7/26

[52] U.S. Cl. ..... 430/548; 430/381; 430/555; 430/558

[58] Field of Search ..... 430/381, 548, 555, 558

[56] References Cited

U.S. PATENT DOCUMENTS

| | | | |
|---|---|---|---|
| 4,367,282 | 1/1983 | Yagihara et al. | 430/381 |
| 4,436,808 | 3/1984 | Yagihara et al. | 430/548 |
| 4,455,366 | 6/1984 | Hirano et al. | 430/558 |
| 4,474,870 | 10/1984 | Yagihara et al. | 430/548 |

*Primary Examiner*—J. Travis Brown

*Attorney, Agent, or Firm*—Sughrue, Mion, Zinn, Macpeak, and Seas

[57] ABSTRACT

A silver halide color photographic light-sensitive material comprising a support having thereon a silver halide emulsion layer containing a magenta color image forming polymer coupler latex which is capable of forming a dye upon coupling with an oxidation product of an aromatic primary amine developing agent and which is a polymer or copolymer having a repeating unit derived from a monomer represented by formula (I)

(I)

wherein [Q] represents a magenta color image forming coupler residue; Za, Zb, Zc and Zd each represents a substituted or unsubstituted methine group, or —N=; $R_1$ represents a hydrogen atom, a lower alkyl group, or a chlorine atom; A represents —NHCO—, —OCO—, or a phenylene group; Y represents —O—, —NH—, —S—, —SO—, —$SO_2$—, —CONH—, —COO—, —NHCO—, or —NHCONH—; B represents an unsubstituted or substituted alkylene aralkylene or phenylene group; m represents 0 or 1; and n represents 0 or 1, provided that when n represents 1, m represents 1 and when n represents 0, m represents 0 or 1.

The polymer coupler latex provides color images having good fastness to light, heat, and humidity and improved granularity.

19 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel magenta color image forming polymer coupler latex capable of coupling with an oxidation product of an aromatic primary amine developing agent.

BACKGROUND OF THE INVENTION

It is known that, for the color development of a silver halide color photographic material, after exposure, an oxidized aromatic primary amine color developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green, and red light, and yellow, magenta, and cyan color image formers, which are respectively the complementary colors of blue, green, and red, are employed. For example, a coupler of the acylacetanilide or benzoylmethane type is used for forming a yellow color image; a coupler of the pyrazolone, pyrazolobenzimidazole, cyanoacetophenone or indazolone type is generally used for forming a magenta color image; and a phenolic type coupler, such as phenols and naphthols, is generally used for forming a cyan color image.

Color couplers must satisfy various requirements. For instance, it is necessary that they have a good spectral property and provide a dye image by color development, having excellent stability to light, temperature, and humidity for a long period of time.

It is also required in a multilayer color photographic light-sensitive material that couplers are fixed in respective layers separated from each other, in order to reduce color mixing and improve color reproduction. Many methods for rendering a coupler diffusion-resistant are known. One method is to introduce a long chain aliphatic group into a coupler molecule in order to prevent diffusion. According to such a method, couplers are solubilized to alkali, and then they are added to an aqueous gelatin solution, or the couplers are dissolved in an organic solvent having a high boiling point, and then they are dispersed in an aqueous gelatin solution, since the couplers are immiscible with an aqueous gelatin solution. Such color couplers may cause crystal formation in a photographic emulsion. Furthermore, when using an organic solvent having a high boiling point, a large amount of gelatin must be employed, since the organic solvent having a high boiling point makes an emulsion layer soft. Consequently, this increases the thickness of the material even though it is desirable to reduce the thickness of the emulsion layer.

Another method for rendering a coupler diffusion-resistant is to utilize a polymer coupler latex obtained by polymerization of a monomeric coupler. An example of a method of adding a polymer coupler in a latex form to a hydrophilic colloid composition is a method in which a latex prepared by an emulsion polymerization method is directly added to a gelatino-silver halide emulsion and a method in which an oleophilic polymer coupler obtained by polymerization of a monomeric coupler is dispersed in a latex form in an aqueous solution. Some examples of the former emulsion polymerization methods include an emulsion polymerization method in an aqueous gelatin phase, as described in U.S. Pat. No. 3,370,952, and an emulsion polymerization method in water, as described in U.S. Pat. No. 4,080,211. An example of the latter method in which an oleophilic polymer coupler is dispersed in a latex form in gelatin is described in U.S. Pat. No. 3,451,820.

The method of adding a polymer coupler in a latex form to a hydrophilic colloid composition has many advantages in comparison with other methods. For example, the deterioration of strength of the film formed is small, because the hydrophobic substance is in a latex form. Also, since the latex can contain monomeric unit of couplers in a high concentration, it is easy to incorporate couplers in a high concentration into a photographic emulsion, and the increase of viscosity is small. Furthermore, color mixing is prevented, since a polymer coupler is completely immobilized and the crystallization of couplers in the emulsion layer is small.

With respect to the addition of these polymer couplers in a latex form to a gelatino-silver halide emulsion, magenta polymer coupler latexes are described, for example, in U.S. Pat. No. 4,080,211, British Pat. No. 1,247,688, U.S. Pat. Nos. 3,451,820, and 3,926,436 West German Pat. No. 2,725,591, etc.

SUMMARY OF THE INVENTION

An object of the present invention is to provide a color photographic light-sensitive material containing a novel two-equivalent magenta color image forming polymer coupler latex that forms a color image having an extraordinarily improved granularity after development processing.

Another object of the present invention is to provide a color photographic light-sensitive material containing a novel two-equivalent magenta color image forming polymer coupler latex that forms a color image fast to light, heat, and heat under humidity in a color photograph after development processing.

Still another object of the present invention is to provide a color photographic light-sensitive material containing a novel two-equivalent magenta color image forming polymer coupler latex which is capable of forming a dye in high efficiency without the formation of fog and stain.

A further object of the present invention is to provide a color photographic light-sensitive material containing a novel two-equivalent magenta color image forming polymer coupler latex which have an improved conversion efficiency to a dye and an improved resistivity to decreases in color forming property upon the attack of chemical substances.

A still further object of the present invention is to provide a color photographic light-sensitive material having a reduced layer thickness and improved sharpness.

Other objects of the present invention will be apparent from the following detailed description and examples.

As a result of extensive investigations, it has now been found that these objects of the present invention are accomplished by the use of a two-equivalent magenta color image forming polymer coupler latex which is a homopolymer of copolymer having a repeating unit derived from a monomeric coupler represented by formula (I)

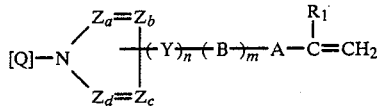

(I)

wherein [Q] represents a magenta color image forming coupler residue, and

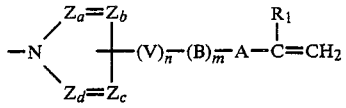

is substituted at a coupling active position of the coupler residue [Q]; $Z_a$, $Z_b$, $Z_c$ and $Z_d$, which may be the same or different, each represents a methine group, a substituted methine group, or —N=, and substituents of methine groups may combine to form a fused ring with the nitrogen containing ring formed by the N atom in the formula, Za, Zb, Zc and Zd; $R_1$ represents a hydrogen atom, a lower alkyl group having from 1 to 4 carbon atoms or a chlorine atom; A represents —NHCO—, —OCO— or a phenylene group; Y represents —O—, —NH—, —S—, —SO—, —$SO_2$—, —CONH—, —COO—, —NHCO—, or —NHCONH—; B represents an unsubstituted or substituted alkylene group which may be a straight chain or a branched chain, an unsubstituted or substituted aralkylene group or a unsubstituted or substituted phenylene group; m represents 0 or 1; and n represents 0 or 1, provided that when n represents 1, m represents 1 and when n represents 0, m represents 0 or 1.

In more detail, the objects of the invention can be accomplished with a silver halide color photographic light-sensitive material comprising a support having thereon a silver halide emulsion layer containing a magenta color image forming polymer coupler latex which is capable of forming a dye upon coupling with an oxidation product of an aromatic primary amine developing agent and which is a homopolymer or copolymer having a repeating unit derived from a monomer represented by formula (I) described above.

DETAILED DESCRIPTION OF THE INVENTION

The novel two-equivalent magenta color image forming polymer coupler latex which can be used in the color photographic material of the present invention includes a homopolymer and copolymer latex derived from a novel two-equivalent magenta monomeric coupler which has at the coupling active position of a magenta color image forming coupler a group capable of being released, and the group capable of being released has a polymerizable group. The novel two-equivalent magenta color image forming polymer coupler latex according to the present invention has no adverse affect on silver halide, and can form a color image fast to heat and light, and, in addition, exhibits great effects on the improvement in granularity of the color image formed. Furthermore, the thickness of an emulsion layer containing the polymer coupler latex of the present invention can be smaller than that of an emulsion layer containing a conventional ballast type coupler. It is because the apparent molecular weight of the polymer coupler per mole of a coupler is smaller than that of a ballast type coupler.

The monomer represented by formula (I) is explained in more detail below.

[Q] in formula (I) represents any magenta color image forming coupler residue, and preferably is a pyrazolone, a pyrazolotriazole, or an imidazopyrazole residue. Preferred examples of the magenta color image forming coupler residues are represented by formula (II), (III), (IV), (V), (VI), (VII), or (VIII).

Formula (II)

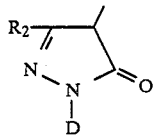

Formula (III)

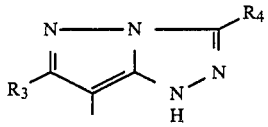

Formula (IV)

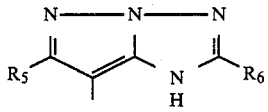

Formula (V)

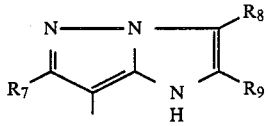

Formula (VI)

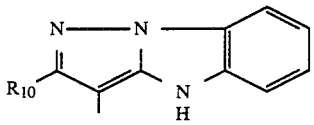

Formula (VII)

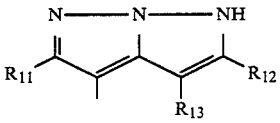

Formula (VIII)

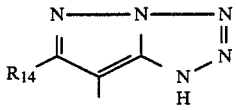

wherein D represents a substituent which is known as a substituent at the 1-position of a 2-pyrazolin-5-one coupler, including, for example, an alkyl group, a substituted alkyl group (for example, a haloalkyl group such as a fluoroalkyl group, a cyanoalkyl group, a benzylalkyl group, etc.), an aryl group or a substituted aryl group (examples of the substituents for the aryl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.). and the like. When two or more substituents are present, they may be the same or different. Particularly preferred substituents include a halogen atom, an alkyl group, an alkoxy group, an alkoxycarbonyl group and a cyano group.);

$R_2$ represents an unsubstituted or substituted anilino group, an unsubstituted or substituted acylamino group (for example, an alkylcarbonamido group, a phenylcarbonamido group, an alkoxycarbonamido group, a phenyloxycarbonamide group, etc.), or an unsubstituted or substituted ureido group (for example, an alkylureido group, a phenylureido group, etc.), and examples of the substituents for these groups include a halogen atom (for example, a fluorine atom, a chlorine atom, a bromine atom, etc.), a straight chain or branched chain alkyl group (for example, a methyl group, a tert-butyl group, an octyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamide group, a butanamide group, a octanamido group, a tetradecanamido group, an α-(2,4-di-tert-amylphenoxy)-acetamido group, an α-(2,4-di-tert-amylphenoxy)butyramido group, an α-(3-pentadecylphenoxy)hexanamido group, an α-(4-hydroxy-3-tert-butylphenoxy)tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, an ethylsulfonamido group, a p-toluenesulfonamido group, an octanesulfonamido group, a p-dodecylbenzenesulfonamido group, an N-methyltetradecanesulfonamido group, etc.), a sulfamoyl group (for example, a sulfamoyl group, an M-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (for example, an N-methylcarbamoyl group, an N-butylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, a butoxysulfonyl group, an octyloxysulfonyl group, a tetradecyloxysulfonyl group, etc.), an aryloxysulfonyl group (for example, a phenoxysulfonyl group, a p-methylphenoxysulfonyl group, a 2,4-di-tert-amylphenoxysulfonyl group, etc.), an alkanesulfonyl group (for example, a methanesulfonyl group, an ethanesulfonyl group, an octanesulfonyl group, a 2-ethylhexylsulfonyl group, a hexadecanesulfonyl group, etc.), an arylsulfonyl group (for example, a benzenesulfonyl group, a 4-nonylbenzenesulfonyl group, etc.), an alkylthio group (for example, a methylthio group, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, a methoxycarbonylamino group, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group, a sulfo group, a hydroxy group or a trichloromethyl group, etc. In the above-described substituents, the alkyl moieties thereof preferably have from 1 to 36 carbon atoms, and the aryl moieties thereof preferably have from 6 to 38 carbon atoms.

$R_3$, $R_4$, $R_5$, $R_6$, $R_7$, $R_8$, $R_9$, $R_{10}$, $R_{11}$, $R_{12}$, $R_{13}$ and $R_{14}$ each represents a hydrogen atom, a hydroxy group, an unsubstituted or substituted alkyl group (preferably those having from 1 to 20 carbon atoms, for example, a methyl group, a propyl group, a tert-butyl group, a trifluoromethyl group, a tridecyl group, etc.), an unsubstituted or substituted aryl group (preferably those having from 6 to 20 carbon atoms, for example, a phenyl group, a 4-tert-butylphenyl group, a 2,4-di-tert-amylphenyl group, a 4-methoxyphenyl group, etc.), an unsubstituted or substituted heterocyclic group (for example, a 2-furyl group, a 2-thienyl group, a 2-pyrimidinyl group, a 2-benzothiazolyl group, etc.), an unsubstituted or substituted alkylamino group (preferably those having from 1 to 20 carbon atoms, for example, a methylamino group, a diethylamino group, a tert-butylamino group, etc.), an unsubstituted or substituted acylamino group (preferably those having from 2 to 20 carbon atoms, for example, an acetylamino group, a propylamido group, a benzamido group, etc.), an unsubstituted or substituted anilino group (for example, a phenylamino group, a 2-chloroanilino group, etc.), an unsubstituted or substituted alkoxycarbonyl group (preferably those having from 2 to 20 carbon atoms, for example, a methoxycarbonyl group, a butoxycarbonyl group, a 2-ethylhexyloxycarbonyl group, etc.), an unsubstituted or substituted alkylcarbonyl group (preferably those having from 2 to 20 carbon atoms, for example, an acetyl group, a butylcarbonyl group, a cyclohexylcarbonyl group, etc.), an unsubstituted or substituted arylcarbonyl group (preferably those having from 7 to 20 carbon atoms, for example, a benzoyl group, a 4-tert-butylbenzoyl group, etc.), an unsubstituted or substituted alkylthio group (preferably those having from 1 to 20 carbon atoms, for example, a methylthio group, an octylthio group, a 2-phenoxyethylthio group, etc.), an unsubstituted or substituted arylthio group (preferably those having from 6 to 20 carbon atoms, for example, a phenylthio group, a 2-butoxy-5-tert-octylphenylthio group, etc.), an unsubstituted or substituted carbamoyl group (preferably those having from 1 to 20 carbon atoms, for example, an N-ethylcarbamoyl group, an N,N-dibutylcarbamoyl group, an N-methyl-N-butylcarbamoyl group, etc.), an unsubstituted or substituted sulfamoyl group (preferably those having up to 20 carbon atoms, for example, an N-ethylsulfamoyl group, an N,N-diethylsulfamoyl group, an N,N-dipropylsulfamoyl group, etc.) or an unsubstituted or substituted sulfonamido group (preferably those having from 1 to 20 carbon atoms, for example, a methanesulfonamido group, a benzenesulfonamido group, a p-toluene-sulfonamido group, etc.).

B in formula (I) represents an unsubstituted or substituted alkylene group; preferably having from 1 to 10 carbon atoms, which may be a straight chain or a branched chain, an unsubstituted or substituted aralkylene group or an unsubstituted or substituted phenylene group. Examples of the alkylene group for B include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group for B include a benzylidene group, etc. Examples of the phenylene group for B include a p-phenylene group, an m-phenylene group, a methylphenylene group, etc.

Substituents for the alkylene group, the aralkylene group, or the phenylene group represented by B include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, methansulfonamido group, etc.), a sulfamonyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

The nitrogen-containing heterocyclic ring formed by N with $Z_a$ to $Z_d$ in formula (I) is derived from a group represented by formula (IX):

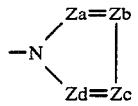

(IX)

wherein Za, Zb, Zc, and Zd, which may be the same or different, each represents an unsubstituted methine group, a substituted methine group (for example, a methine group substituted with a straight chain or branched chain alkyl group having from 1 to 10 carbon atoms, a cycloalkyl group, an aralkyl group, an aryl group, or a heterocyclic group, and further a methine group substituted with an alkoxycarbonyl group, an aryloxycarbonyl group, an aralkyloxycarbonyl group, an alkoxy group, an aryloxy group, an alkylthio group, a carboxy group, an acylamino group, a diacylamino group, an N-alkylacylamino group, an N-arylacylamino group, a ureido group, a thioureido group, an alkyloxycarbonylamino group, an aryloxycarbonylamino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, an alkylsulfonyl group, an arylsulfonyl group, a halogen atom, a sulfo group or a nitro group), or —N=.

Preferred specific examples of a nitrogen-containing heterocyclic group which is formed by Za, Zb, Zc, Zd and —N> in formula (IX) and released upon coupling with the oxidation product of an aromatic primary amine developing agent include a pyrazolyl group, an imidazolyl group, a triazolyl group, and a tetrazolyl group. Of these groups, a pyrazolyl group is particularly preferred.

Two or more substituents of $Z_a$, $Z_b$, $Z_c$, and $Z_d$ may be substituted and the substituents may be bonded each other to form a ring such as a benzimidazolyl group and a benzotriazolyl group.

Preferred specific examples of the monomer couplers used in the present invention are set forth below, but the present invention is not to be construed as being limited thereto.

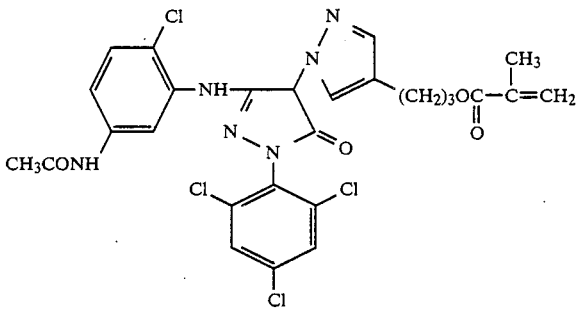

(1)

-continued
(2)
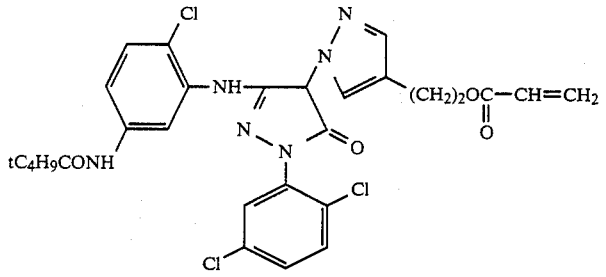
(3)
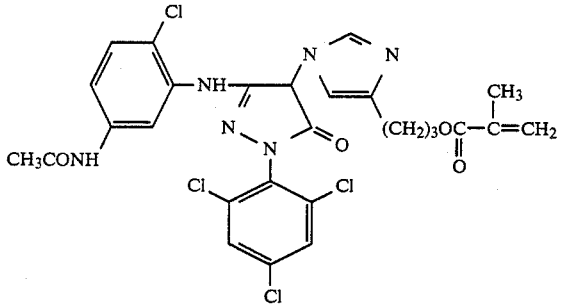
(4)
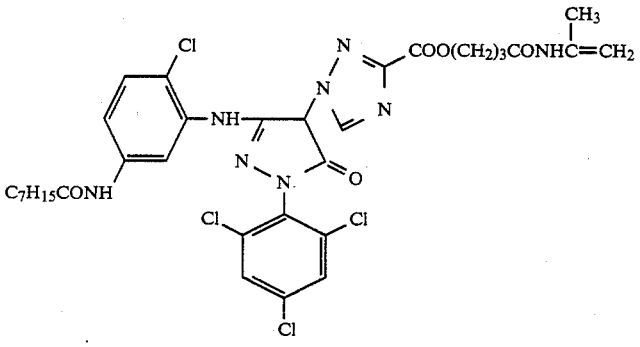
(5)
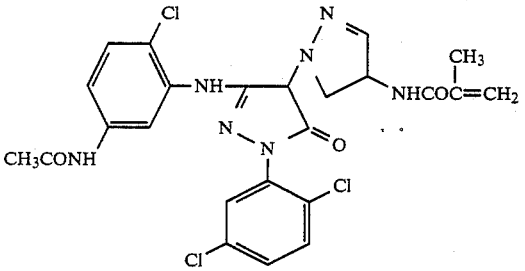
(6)
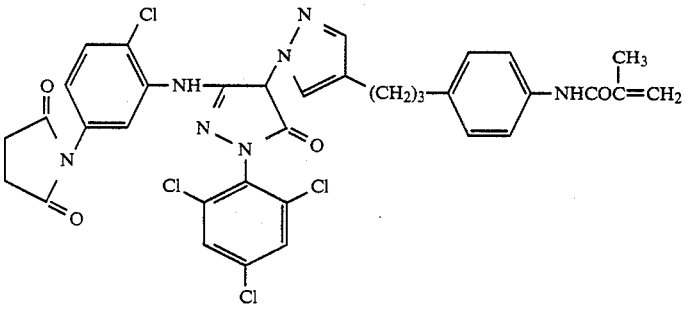

-continued
(7)
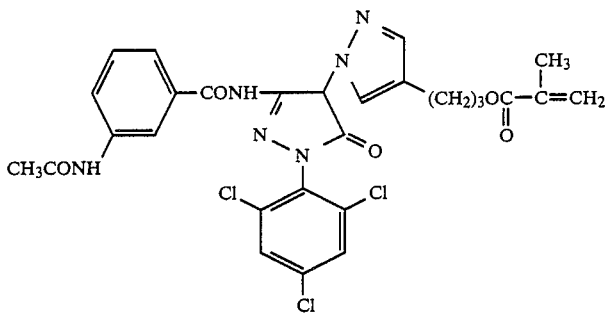
(8)
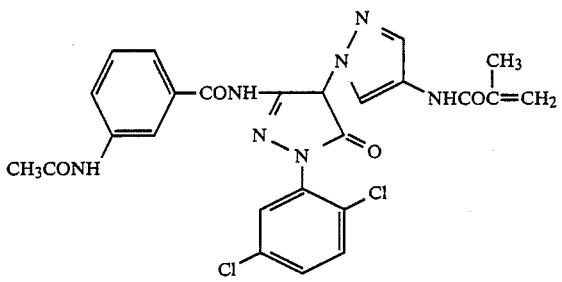
(9)
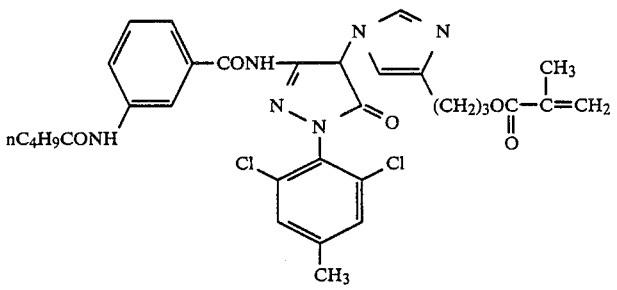
(10)
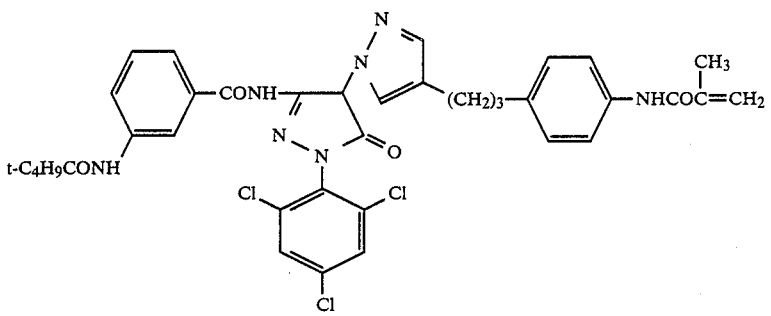
(11)
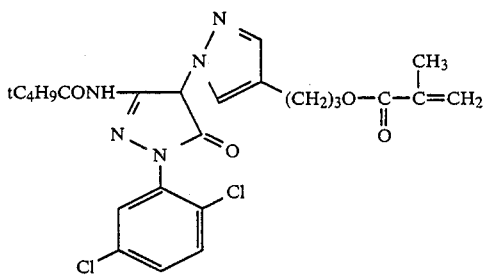

-continued
(12)
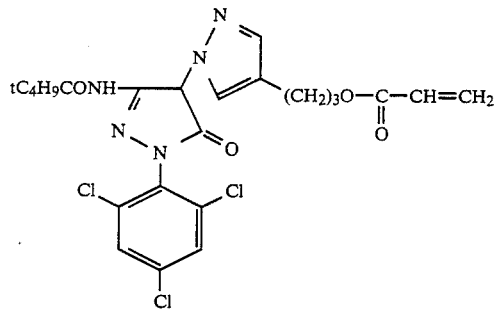
(13)
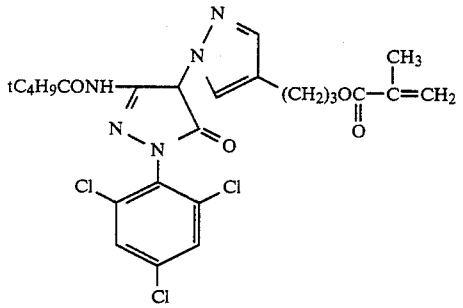
(14)
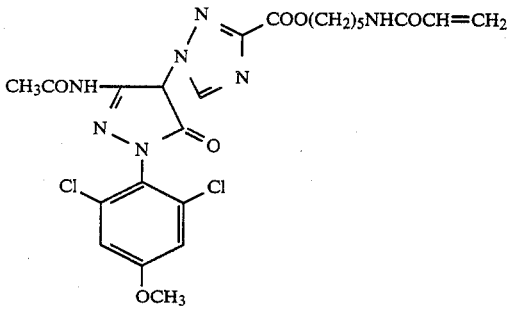
(15)
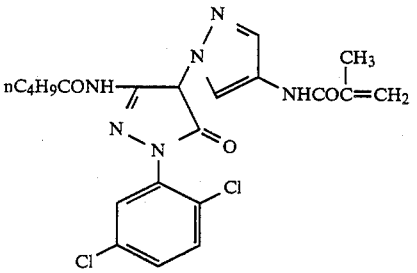
(16)
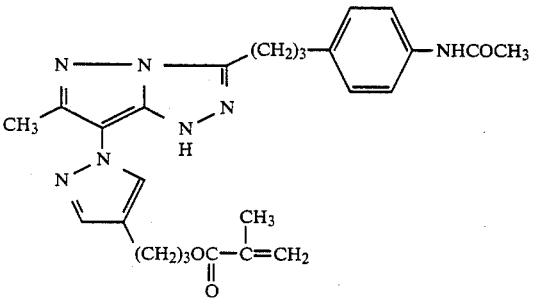

-continued
(17)
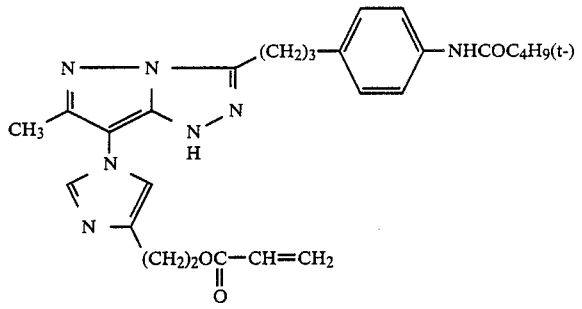
(18)
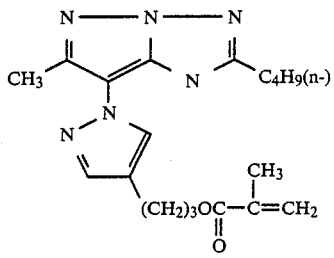
(19)
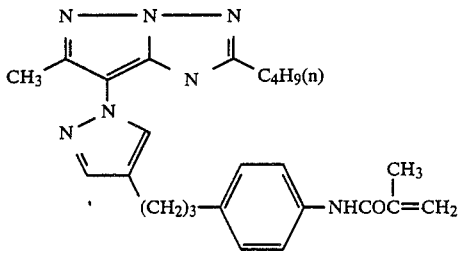
(20)
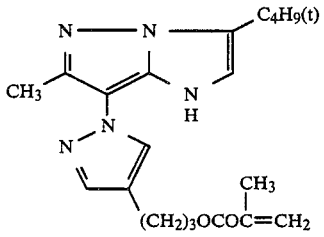
(21)
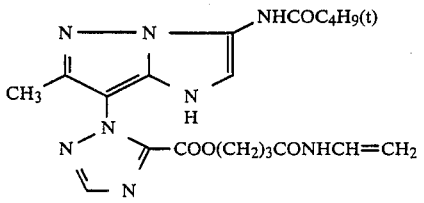
(22)
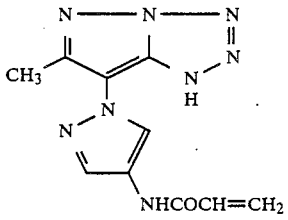

-continued (23)

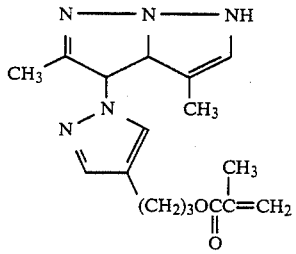

(24)

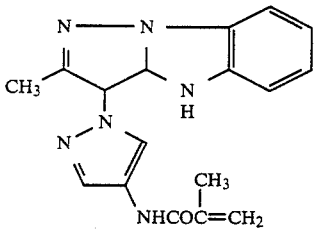

The monomer coupler represented by formula (I) according to the present invention can be obtained in general by reacting a magenta coupler having a halogen atom at the coupling active position thereof with a nitrogen-containing aromatic heterocyclic compound using the following reaction scheme, described, e.g., in Japanese Patent Application (OPI) Nos. 30826/76, 58922/77, 118034/80, 38043/81 and 94752/82. The latter four Applications correspond to U.S. Pat. Nos. 4,076,533, 4,310,619, 4,301,235 and 4,367,282, respectively.

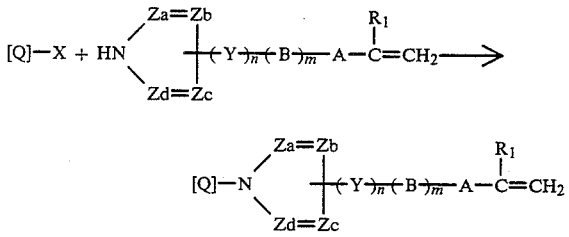

In the above formulae, Q, A, B, Y, Za, Zb, Zc, Zd, n and m each has the same meaning as defined above; and x represents a halogen atom (for example, a chlorine atom or a bromine atom) which is a substituent at the coupling active position of a magenta coupler.

In the above-described synthesis procedure, the reaction of a coupler which is halogenated at the coupling active position with a nitrogen-containing aromatic heterocyclic compound which is converted to a group capable of being released can be carried out in a temperature range from 0° C. to 200° C., in a various kinds of solvents, or in a fusiung method without using a solvent. The preferred range of the temperature is from 20° C. to 150° C., and in the case of a fusing method without solvent, it is not necessary to raise more than the melting temperature at which both compounds melt.

Preferred examples of the solvents include an alcoholic solvent (such as methanol, ethanol, propanol, etc.), an aromatic solvent (such as benzene, toluene, xylene, etc.), an aprotic polar solvent (such as dimethylformamide, sulfolane, etc.), and the like.

In the reaction, the nitrogen-containing aromatic heterocyclic compound present in an excess amount can be used as a hydrogen halide-eliminating agent and thus a base is not particularly required. However, the base can be used, if desired.

The monomer coupler may be obtained using a nitrogen-containing aromatic heterocyclic compound having a hydroxy group or an amino group instead of —A—$CR_1$=$CH_2$, by reacting it with Q—Z, and then reacting the thus obtained product an an acid chloride having a vinyl group to synthesize a monomer coupler.

A typical synthesis example of the monomer coupler according to the present invention is set forth below.

SYNTHESIS EXAMPLE 1

Synthesis of Monomer Coupler (13)

68.1 g of 4-bromo-1-(2,4,6-trichlorophenyl)-3-pivaloylamino-5-pyrazolone and 58.3 g of 4-(3-hydroxypropyl)pyrazole were added to 100 ml of N,N-dimethylformamide and the mixture was stirred at 60° C. for 7 hours. After allowing cooling to room temperature, 200 ml of ethyl acetate was added to the mixture which was put into a separating funnel and washed with 1N aqueous hydrochloric acid. After washing with water until the wash liquid became neutral, the oil layer was separated and concentrated under reduced pressure. To the residue was added acetonitrile and the crystals thus-precipitated were collected by filtration and dried to obtain 51.8 g of (1-(2,4,6-trichlorophenyl)-4-{4-(3-hydroxypropyl)pyrazolyl-3-pivaloylamino-5-pyrazolone.

38.7 g of the crystals thus-obtained and 23 g of triethylamine were added to 150 ml of acetonitrile, to the thus obtained mixture was added dropwise 23 g of methacrylic chloride under cooling below 10° C. After reacting for 1 hour, 300 ml of ethyl acetate was added to the mixture which was put into a separating funnel and treated with aqueous ammonia. After washing with water until the wash liquid became neutral, the oil layer was separated and concentrated under reduced pressure. To the residue was added acetonitrile and the crystals thus-precipitated were collected by filtration and recrystallized from acetonitrile to obtain 29.6 g of Monomer Coupler (13).

Elemental Analysis for $C_{24}H_{26}N_5O_4Cl_3$ Calculated: C:51.95%; H:4.73%; N:12.62% Found: C:51.83%; H:4.78%; N:12.71%

The polymer coupler latexes according to the present invention may include a homopolymer of one of the monomer couplers represented by formula (I), a copolymer of two or more of the monomer couplers represented by formula (I) or a copolymer of at least one of the monomer couplers represented by formula (I) and at least one of non-color forming ethylenic monomers which do not couple with the oxidation product of an aromatic primary amine developing agent. In the latter case, two or more kinds of the monomer couplers represented by formula (I) may also be employed.

Of the polymer coupler latexes, copolymers of the monomer coupler represented by formula (I) and a non-color forming ethylenic monomer as described below are preferred.

Examples of the non-color forming ethylenic monomer which does not couple with the oxidation product of an aromatic primary amine developing agent include an acrylic acid, for example, acrylic acid, α-chloroacrylic acid, an α-alkylacrylic acid (such as methacrylic acid, etc.), etc., an ester or amide derived from an acrylic acid (for example, acrylamide, methacrylamide, n-butylacrylamide, t-butylacrylamide, diacetone acrylamide, methyl acrylate, ethyl acrylate, n-propyl acrylate, n-butyl acrylate, ter-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), a vinyl ester (for example, vinyl acetate, vinyl propionate, vinyl laurate, etc.), acrylonitrile, methacrylonitrile, an aromatic vinyl compound (for example, styrene and a derivative thereof, for example, vinyl toluene, divinyl benzene, vinyl acetophenone, sulfostyrene, etc.), itaconic acid, citraconic acid, crotonic acid, vinylidene chloride, a vinyl alkyl ether (for example, vinyl ethyl ether, etc.), an ester of maleic acid, N-vinyl-2-pyrrolidone, N-vinylpyridine, 2- or 4-vinylpyridine, etc.

Of these monomers, an ester of acrylic acid, an ester of methacrylic acid, and an ester of maleic acid are particularly preferred.

Two or more non-color forming ethylenic unsaturated monomers can be used together. For example, a combination of methyl acrylate and butyl acrylate, butyl acrylate and styrene, butyl methacrylate and methacrylic acid, methyl acrylate and diacetone acrylamide, etc., can be used.

The ethylenically unsaturated monomer which is used to copolymerize with the monomer coupler represented by the above-described general formula (I) can be selected so that the copolymer to be formed possesses appropriate physical properties and/or chemical properties, for example, solubility, compatibility with a binder such as gelatin in a photographic colloid composition, flexibility, heat stability, etc., as is well known in the field of polymer couplers.

The magenta polymer coupler latex used in the present invention can be prepared by dissolving an oleophilic polymer coupler obtained by polymerization of a monomer coupler in an organic solvent and then dispersing the solution in a latex form in an aqueous gelatin solution, or directly by an emulsion polymerization method as described above.

With repsect to the method in which an oleophilic polymer coupler is dispersed in a latex form in an aqueous gelatin solution, the method as described in U.S. Pat. No. 3,451,820 and with respect to the emulsion polymerization, the methods as described in U.S. Pat. Nos. 4,080,211 and 3,370,952 can be employed, respectively.

In the syntheses of the magenta polymer coupler latexes according to the present invention, as polymerization initiators and polymerization solvents, compounds as described in Japanese Patent Applciation (OPI) Nos. 5543/81, 94752/82, 176038/82, 204038/82, 28745/83, 10738/83, and 42044/83, Japanese Patent Application Nl. 29683/82, etc., can be employed. The latter seven Applications correspond to U.S. Pat. Nos. 4,367,282 and 4,388,404, U.S. patent application Ser. Nos. 387,128 and 377,271, U.S. Pat. Nos. 4,435,503, 4,444,870, and 4,436,808, respectively.

The polymerization temperature should be selected depending on a molecular amount of the polymer to be synthsized, the kind of initiator used, etc. Although it is possible to use a temperature range from 0° C. or below to 100° C. or more, the polymerization is usually carried out in a range from 30° C. to 100° C. The polymerization degree of the polymer is usually from about 10,000–150,000.

It is preferable that the amount of the color forming portion corresponding to the monomer represented by formula (I) in the copolymer coupler latex be from 5 to 80% by weight. Particularly, an amount of from 20 to 70% by weight is preferred in view of color reproducibility, color forming property, and stability. In this case, an equivalent molecular weight, that is, the gram number of the polymer containing 1 mol of a coupler monomer, is from about 250 to 4,000, but it is not limited thereto.

Typical synthesis examples of the polymer couplers according to the present invention are set forth below.

Synthesis Method I

SYNTHESIS EXAMPLE 2

Synthesis of Copolymer coupler of 1-(2,4,6-trichlorophenyl)-4-(4-methacryloyloxypropylpyrazolyl)-3-pivaloylamino-5-pyrazolone [Monomer Coupler (13)] and butyl acrylate [Oleophilic Polymer Coupler (I)]

A mixture of 20 g of Monomer Coupler (13), 20 g of butyl acrylate and 200 ml of dioxane was heated to 80° C. with stirring while introducing nitrogen gas through the mixture, to which was added 20 ml of a dioxane solution containing 0.5 g of dimethyl azobisisobutyrate to initiate polymerization. After being reacted for 5 hours, the reaction solution was cooled, poured into 1.5 liters of water, the solid thus-deposited was collected by filtration and thoroughly washed with water. By drying the solid under reduced pressure with heating, 37.6 g of Oleophilic Polymer Coupler (I) was obtained. It was found that the oleophilic polymer coupler contained 50.2% of Monomer Coupler (13) in the copolymer synthesized, as a result of chlorine analysis.

SYNTHESIS EXAMPLE 3

Synthesis of Copolymer Coupler of 1-(2,5-dichlorophenyl)-4-(4-methacrylamidopyrazolyl)-3-pivaloylamino-5-pyrazolone [Monomer Coupler (15)] and methyl acrylate [Oleophilic Polymer Coupler (II)]

A mixture of 20 g of Monomer Coupler (15), 20 g of methyl acrylate and 120 ml of methyl cellosolve was heated to 65° C. with stirring while introducing nitrogen gas through the mixture, to which was added 20 ml of a methyl cellosolve solution containing 0.4 g of dimethyl azobisisobutyrate to initiate polymerization. After being reacted for 8 hours, the reaction solution was cooled, poured into 1 liter of water, the solid thus-deposited was collected by filtration and thoroughly washed with water. By drying the solid under reduced pressure with heating, 37.1 g of Oleophilic Polymer Coupler (II) was obtained. It was found that the oleophilic polymer coupler contained 52.4% of Monomer Coupler (15) in the copolymer synthesized, as a result of chlorine analysis.

Synthesis Example 4–17
Oleophilic Polymer Coupler by Synthesis Method I

| Synthesis Example | Oleophilic Polymer Coupler | Monomer Coupler | Amount (g) | Non-color Forming Monomer | Amount (g) | Monomer Coupler Unit in Polymer (wt %) |
|---|---|---|---|---|---|---|
| 4 | III | (1) | 20 g | EA | 20 g | 51.6 |
| 5 | IV | (2) | 20 g | MA | 80 g | 23.0 |
| 6 | V | (4) | 20 g | BA | 20 g | 45.1 |
| | | | | DAAM | 5 g | |
| 7 | VI | (7) | 20 g | MA | 50 g | 30.3 |
| 8 | VII | (8) | 20 g | MMA | 20 g | 42.5 |
| | | | | MAA | 10 g | |
| 9 | VIII | (11) | 20 g | EA | 20 g | 51.2 |
| 10 | IX | (12) | 20 g | MA | 20 g | 52.5 |
| 11 | X | (13) | 20 g | MA | 13 g | 63.4 |
| 12 | XI | (14) | 20 g | BA | 13 g | 61.8 |
| 13 | XII | (15) | 20 g | BA | 20 g | 50.2 |
| 14 | XIII | (16) | 20 g | BA | 20 g | 50.6 |
| 15 | XIV | (18) | 20 g | BA | 20 g | 50.5 |
| 16 | XV | (20) | 20 g | BA | 20 g | 50.6 |
| 17 | XVI | (22) | 20 g | BA | 20 g | 50.9 |

MA: Methyl Acrylate
BA: Butyl Acrylate
MAA: Methacrylic Acid
EA: Ethyl Acrylate
MMA: Methyl Methacrylate
DAAM: Diacetone Acrylamide The amounts of the monomer couplers and the non-color forming monomers in the above table indicate amounts used in the synthesis of the polymer couplers.

Synthesis Method II

SYNTHESIS EXAMPLE 18

Copolymer latex or 1-(2,4,6-trichlorophenyl)-3-(3-acetamido-6-chloroanilino)-4-(4-methacryloyloxypropylpyrazolyl)-5-pyrazolone [Monomer Coupler (1)] and butyl acrylate [Polymer Coupler Latex (A)]

1.2 liters of an aqueous solution containing 3 g of oleyl methyl tauride dissolved was stirred and heated to 85° C. while introducing nitrogen gas through the solution in a 2 liter flask. To the solution was added 30 ml of a 2% aqueous solution of potassium persulfate and then was added dropwise a solution containing 20 g of Monomer Coupler (1) and 40 g of butyl acrylate dissolved by heating in 400 ml of methanol over a period of 20 minutes. After being reacted for 2 hours, methanol was distilled off. The latex thus-formed was cooled, pH of which was adjusted to 6.0 with a 1N sodium hydroxide solution and filtered. The concentration of the polymer in the latex was 5.2% and it was found that the copolymer synthesized contained 34.0% of Monomer Coupler (1), as a result of chlorine analysis.

Synthesis Example 19–32
Polymer Coupler Latexes by Synthesis Method II

| Synthesis Example | Polymer Coupler Latex | Monomer Coupler | Amount (g) | Non-color Forming Monomer | Amount (g) | Monomer Coupler Unit in Polymer (wt %) |
|---|---|---|---|---|---|---|
| 19 | B | (2) | 20 g | MA | 50 g | 29.8 |
| 20 | C | (3) | 20 g | BA | 50 g | 28.6 |
| 21 | D | (5) | 20 g | BA | 20 g | 49.3 |
| 22 | E | (7) | 20 g | BA | 20 g | 49.7 |
| 23 | F | (8) | 20 g | MA | 20 g | 46.2 |
| | | | | MAA | 5 g | |
| 24 | G | (11) | 20 g | EA | 20 g | 50.8 |
| 25 | H | (12) | 20 g | MA | 13 g | 61.6 |
| 26 | I | (13) | 20 g | MA | 20 g | 52.1 |
| 27 | J | (14) | 20 g | BA | 10 g | 66.6 |
| 28 | K | (15) | 20 g | MA | 40 g | 34.5 |
| 29 | L | (16) | 20 g | BA | 20 g | 50.1 |
| 30 | M | (18) | 20 g | BA | 20 g | 49.6 |
| 31 | N | (20) | 20 g | BA | 20 g | 48.2 |
| 32 | O | (22) | 20 g | BA | 20 g | 49.0 |

The amounts of the monomer couplers and the non-color forming monomers in the above table indicate amounts used in the synthesis of the polymer coupler latexes.

The magenta polymer coupler latexes according to the present invention can be used individually or as mixtures of two or more thereof.

The magenta polymer coupler latexes according to the present invention can also be used together with a magenta polymer coupler latex, such as those described in U.S. Pat. No. 4,080,211, British Pat. No. 1,247,688, etc.

Further, a dispersion which is prepared by dispersing a hydrophobic magenta color forming coupler, for example, a magenta coupler, as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78 etc., in a hydrophilic colloid in a manner as described, for example, in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the magenta polymer coupler latex according to the present invention in a manner as described in Japanese Patent Application (OPI) No. 39853/76, etc., and the resulting latex can be used. It is also possible for the above-described hydrophobic magenta coupler to be loaded into the magenta polymer coupler latex according to the present invention in a manner as described in Japanese Patent Application (OPI) Nos. 59942/76 and 32552/79, U.S. Pat. No. 4,199,363, etc., and the resulting latex can be used. The term "load" used herein refers to the state in which a hydrophobic magenta coupler is incorporated into the interior of a magenta polymer coupler latex, or a state in which a hydrophobic magenta coupler is deposited on the surface of a magenta polymer coupler latex. However, the mechanism by which the load occurs is not accurately known.

In order to satisfy the characteristics required of the photogrpahic light-sensitive material, a dispersion which is prepared by dispersing a development inhibitor releasing (DIR) coupler as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc., in a hydrophilic colloid in a manner as described in U.S. Pat. Nos. 2,269,158, 2,272,191, 2,304,940, 2,311,020, 2,322,027, 2,360,389, 2,772,163, 2,801,170, 2,801,171 and 3,619,195, British Pat. No. 1,151,590, West German Pat. No. 1,143,707, etc., is loaded into the magenta polymer coupler latex according to the present invention in a manner as described in Japanese Patent Application (OPI) No. 39853/76. The resulting latex can then be used, or the above-described DIR coupler is loaded into the magenta polymer coupler latex in a manner as described in Japanese Patent Application (OPI) Nos. 59942/76 and 32552/79, U.S. Pat. No. 4,199,363, etc., and the resulting latex can then be used.

Furthermore, the magenta polymer coupler latex according to the present invention can be used together with a DIR compound as described, for example, in West German Patent Application (OLS) Nos. 2,529,350, 2,448,063 and 2,610,546, U.S. Pat. Nos. 3,928,041, 3,958,993, 3,961,959, 4,049,455, 4,052,213, 3,379,529, 3,043,690, 3,364,022, 3,297,445 and 3,287,129.

Moreover, the magenta polymer coupler latex according to the present invention can be used in combination with a colored magenta coupler as described, for example, in U.S. Pat. No. 2,449,966, West German Pat. No. 2,024,186, Japanese Patent Application (OPI) Nos. 123625/74, 131448/74 and 42121/77, etc., a competing coupler as described, for example, in U.S. Pat. Nos. 3,876,428, 3,580,722, 2,998,314, 2,808,329, 2,742,832 and 2,689,793, etc., a stain preventing agent as described, for example, in U.S. Pat. Nos. 2,336,327, 2,728,659, 2,403,721, 2,701,197 and 3,700,453, etc., a dye image stabilizing agent as described, for example, in British Pat. No. 1,326,889, U.S. Pat. Nos. 3,432,300, 3,698,909, 3,574,627, 3,573,050 and 3,764,337, etc., or the like.

The color photographic light-sensitive material produced according to the present invention can also contain conventionally well known coupler(s) other than a magenta color forming coupler. A non-diffusible coupler which contains a hydrophobic group, called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor upon a development can also be present therein. Furthermore, a coupler which provides a colorless product upon coupling can be employed.

A known open chain ketomethylene type coupler can be used as a yellow color forming coupler. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Patent 1,425,020, Japanese Patent Publication No. 10783/76, Japanese Patent Application (OPI) Nos. 26133/72, 73147/73, 102636/76, 6341/75, 123342/75, 130442/75, 21827/76 and 87650/75, etc.

A phenol type compound, a naphthol type compound, etc., can be employed as a cyan color forming coupler. Specific examples of cyan color forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 73050/80, etc.

Two or more kinds of the couplers described above can be incorporated into the same layer, or the same coupler compound can also be present in two or more layers.

A known method, for example, the method as described in U.S. Pat. No. 2,322,027, can be used in order to incorporate the couplers described above into a silver halide emulsion layer. The coupler is dispersed in a hydrophilic colloid and then mixed with a silver halide emulsion. When a coupler having an acid group such as a carboxylic acid group, a sulfonic acid group, etc., is used, it can be incorporated into a hydrophilic colloid as an alkaline aqueous solution thereof.

The silver halide emulsion which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of a photographic light-sensitive material from dispersions having a uniform grain size, those having a wide grain size distribution, or from dispersions having an average grain size of from about 0.1 micron to 3 microns. Also, these silver halide emulsions can be subjected to chemical sensitization, such as sulfur sensitization, gold sensitization, reduction sensitization, etc., and can contain a speed increasing agent such as a polyoxyethylene compound, an onium compound, etc. Further, a silver halide emulsion of the type wherein latent images are predominantly formed on the surface of the grains or of the internal latent image type where latent images are predominantly formed inside the grains can be used in the present invention. Also, two or more kinds of silver halide photographic emulsions prepared separately and then mixed can be employed.

As a hydrophilic high molecular weight substance composed of the photographic light-sensitive layer of the present invention, a protein such as gelatin, etc., a high molecular weight non-electrolyte such as polyvinyl alcohol, polyvinyl pyrrolidone, polyacrylamide, etc., an acidic polymer such as an alginate, a polyacrylic acid salt, etc., a high moleculafr weight ampholite such as a polyacrylamide treated by the Hoffman rearrangement reaction, a copolymer of acrylic acid and N-vinylimidazole, etc., a cross-linking polymer as described in U.S. Pat. No. 4,215,195, and the like are suitable. Furthermore, a hydrophobic polymer dispersion such as a latex of polybutyl acrylate, etc., can be included in the continuous phase of such a hydrophilic high molecular weight substance.

Various compounds can be added to the photographic emulsions used in the present invention in order to prevent a reduction of the sensitivity or formation of fog during preparation, storage, or processing. A wide variety of such compounds are known, such as heterocyclic compounds, mercury-containing compounds, mercapto compounds or metal salts, including 4-hydroxy-6-methyl-1,3,3a,7-tetraazaindene, 3-methylbenzothiazole and 1-phenyl-5-mercaptotetrazole. Examples of such compounds which can be used are described, for example, in *Research Disclosure,* No. 17643, page 24, "VI Antifoggant and Stabilizer" (Nov., 1978) and the literature references cited therein.

The photograhic emulsion used in the present invention can also contain one or more surface active agents. These surface active agents are commonly used as a coating aid. However, in some cases they are used for other purposes such as an emulsifier, a dispersant, a sensitizer, an anti-static agent, or an adhesion preventing agent.

The surface active agents can be classified into various groups, as follows: natural surface active agents such as saponin; nonionic surface active agents such as alkylene oxides, glycerols and glycidols; cationic surface active agents such as higher alkylamines, quaternary ammonium salts, heterocyclic compounds such as pyridine and the like, phosphoniums or sulfoniums; anionic surface active agents containing an acid group such as a carboxylic acid group, a sulfonic acid group, a phosphoric acid group, a sulfuric acid ester group, or phosphoric acid ester group; amphoteric surface active agents such as aminoacids, aminosulfonic acids, aminoalcohol sulfuric acid esters or aminoalcohol phosphoric acid esters.

The photographic emulsion can be spectrally sensitized, or supersensitized, using a cyanine-type dye, such as a cyanine, merocyanine, carbocyanine, etc., individually, in combinations, or in combination with a styryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68 and 14030/69, etc. The sensitizers can be selected as desired depending on the purposes and use of the photographic materials to be sensitized e.g., with respect to their wave-length, sensitivity, etc.

The hydrophilic colloid layer, and in particular a gelatin layer in the photographic light-sensitive material used in the present invention, can be hardened using various kinds of cross-linking agents. For instance, an inorganic compound such as a chromium salt and a zirconium salt, or an aldehyde type cross-linking agent such as mucochloric acid, or 2-phenoxy-3-chloromalealdehydic acid as described in Japanese Patent Publication No. 1872/71 can be effectively used in the present invention. However, non-aldehyde type cross-linking agents such as compounds having plural epoxy rings as described in Japanese Patent Publication No. 7133/59, the poly(1-aziridinyl) compounds as described in Japanese Patent Publication No. 8790/62, the active halogen compounds as described in U.S. Pat. Nos. 3,362,827 and 3,325,287 and the vinyl sulfone compounds as described in U.S. Pat. Nos. 2,994,611 and 3,582,322, Belgian Pat. No. 686,440, etc., are particularly suitable for use in the photographic light-sensitive material of the present invention.

The silver halide photographic emulsion of the present invention is suitably applied to a support. Illustrative supports include rigid materials such as glass, metal and ceramics, and flexible materials and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an α-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also, two or more layers can be coated simultaneously, using methods as described in U.S. Pat. Nos. 2,761,791, 3,508,947, 2,941,898, 3,526,528, etc.

The present invention is applicable to not only the so-called multilayer type photographic light-sensitive material comprising a support having superimposed thereon emulsion layers, each of which is sensitive to radiation of a substantially different wavelength region and forms color images of a substantially different hue, but also the so-called mixed packet type photographic light-sensitive material comprising a support having coated thereon a layer containing packets which are sensitive to radiation of substantially different wavelength regions and form color images of a substantially different hue. The present invention can be applied to a color negative film, a color positive film, a color reversal film, a color printing paper, a color reversal printing paper, and the like.

The color photographic light-sensitive material of the present invention is, after exposure, subjected to a development processing to form dye images. Development processing includes basically a color development step, a bleaching step and a fixing step. Each step can be carried out individually or two or more steps can be combined as one step where a processing solution having two or more functions is used. Also, each step can be separated into two or more steps. The development processing can further include a pre-hardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developer solution is an alkaline solution having a pH of more than 8, preferably from 9 to 12, and containing, as a developing agent, a compound whode oxidation product is capable of forming a colored compound when reacted with a color forming agent, i.e., a color coupler. The developing agent described above includes a compound capable of developing an exposed silver halide and having a primary amino group on an aromatic ring, and a precursor which forms such compound. Typical examples of preferred developing agents are, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diethylaniline, and the salts thereof (for example, the sulfates, the hydrochlorides, the sulfites, the p-toluene sulfonates, and the like). Other developing agents such as those described in U.S. Pat. Nos. 2,193,015 and 2,592,364, Japanese Patent Application (OPI) No. 64933/73, L. F. A. Mason, *Photographic Processing Chemistry,* pages 226–229, Focal Press, London (1966), T. H. James, *The Theory of the Photographic Process,* 4th Edition, pages 315–320, Macmillan, New York (1977), etc., can be used. Further, an aminophenol as described in T. H. James, *The Theory of the Photographic Process,* 4th Edition, pages 311–315, etc., can be used. Also, a 3-pyrazolidone developing agent can be used together with these developing agents.

The color developer solution can optionally contain various additives. Typical examples of such additives include alkaline agents (for example, alkali metal or ammonium hydroxides, carbonates or phosphates); pH-adjusting agents or buffers (for example, weak acids such as acetic acid, boric acid, etc., weak bases, or salts thereof); developing accelerators (for example, various pyridinium compounds or cationic compounds such as those described in U.S. Pat. Nos. 2,648,604 and 3,671,247; potassium nitrate; sodium nitrate; condensation products of polyethylene glycol, and their derivatives such as those described in U.S. Pat. Nos. 2,533,990, 2,577,127 and 2,950,970; noinonic compounds such as polythioethers represented by those described in British Pat. Nos. 1,020,033 and 1,020,032; polymeric compounds having sulfite ester groups such as those described in U.S. Pat. No. 3,068,097; organic amines such as pyridine and ethanolamine; benzyl alcohol; hydrazines and the like); anti-fogging agents (for example, alkali metal bromides; alkali metal iodides; nitrobenzimidazoles such as those described in U.S. Pat. Nos. 2,496,940 and 2,656,271; mercaptobenzimidazole; 5-methylbenztriazole; 1-phenyl-5-mercaptotetrazole; compounds for use in rapid processing such as those described in U.S. Pat. Nos. 3,113,864, 3,342,596, 3,295,986, 3,615,522 and 3,597,199; thiosulfonyl compounds such as those described in British Pat. No. 972,211; phenazine-N-oxides such as those described in Japanese Patent Publication No. 41675/71; those described in *Kagaku Shashin Binran (Manual of Scientific Photography)*, Vol. II, pages 29–47, and the like); stain or sludge preventing agents such as those described in U.S. Pat. Nos. 3,161,513 and 3,161,514, and British Pat. Nos. 1,030,442, 1,144,481 and 1,251,558; interlayer-effect accelerators such as those disclosed in U.S. Pat. No. 3,536,487; preservatives (for example, sulfites, bisulfites, hydroxyamine hydrochloride, formsulfite, alkanolaminesulfite adducts, etc.) and the like.

The color photographic light-sensitive material of the present invention can be treated with various solutions prior to color development.

In the case of color reversal films, treatment with a first development solution is also carried out prior to the color development. As the first development solution, an alkaline aqueous solution containing at least one developing agent, such as hydroquinone, 1-phenyl-3-pyrazolidione, N-methyl-p-aminophenol and the like can be employed. The solution can also contain inorganic salts such as sodium sulfate; pH-adjusting agents or buffers such as borax, boric acid, sodium hydroxide and sodium carbonate; development fog inhibitors such as alkali metal halides (such as potassium bromide, etc.), and the like.

The additives illustrated above and the amounts thereof employed are well known in the color processing field.

After color development, the color photographic materials are usually bleached and fixed. The processes can be effected in a blix bath which combines the bleaching and fixing steps. Various compounds can be used as a bleaching agent, for example, ferricyanides; dichromates; water-soluble iron (III) salts; water-soluble cobalt (III) salts; water-soluble copper (II) salts; water-soluble quinones; nitrosophenols; complex salts of a polyvalent cation such as iron (III), cobalt (III), copper (II), etc., and an organic acid, for example, metal complex of an aminopolycarboxylic acid such as ethylenediaminetetraacetic acid, nitrilotriacetic acid, iminodiacetic acid, N-hydroxyethylethylenediaminetriacetic acid, etc., malonic acid, tartaric acid, malic acid, diglycolic acid and dithioglycolic acid, and copper complex salt of 2,6-dipicolinic acid; peracids such as alkylperacids, persulfates, permanganates and hydrogen peroxide; hypochlorites; chlorine; bromine; bleaching powder; and the like. These can be suitably used, individually or in combination. To the bleaching solution, bleaching accelerators such as those described in U.S. Pat. Nos. 3,042,520 and 3,241,966, Japanese Patent Publication Nos. 8506/70 and 8836/70 and various other additives can be added.

Any known fixing solution can be used for fixing the photographic materials of the present invention. That is, ammonium, sodium, or potassium thiosulfate can be used as a fixing agent at a concentration of about 50 to about 200 g/liter. Fixing solutions can further contain stabilizers such as sulfites and metabisulfites; hardeners such as potassium alum; pH buffers such as acetates and borates, and the like. The fixing solution generally has a pH of more than 3 or less.

Bleaching baths, fixing baths and blixing baths as described, for example, in U.S. Pat. No. 3,582,322, Japanese Patent Application (OPI) No. 101934/73, West German Pat. No. 1,051,117 can also be employed.

The present invention will be explained in greater detail with reference to the following examples, but the present invention should not be construed as being limited thereto.

EXAMPLE 1

20 g of each of Oleophilic Polymer Couplers (I) and (II) according to the present invention and Comparative Oleophilic Polymer Coupler (a) was dissolved by heating in 60 ml of ethyl acetate and the solution was mixed with 10 ml of a 10% by weight aqueous solution of Alkanol B (alkylnaphthalene sulfonate, manufactured by E. I. du Pont de Nemours and Co.) and 200 ml of a 4.0% by weight aqueous gelatin solution. The resulting mixture was stirred with a high speed using a homogenizer to prepare Oleophilic Polymer Coupler Latexes (I′), (II′) and (a′), respectively. Each of the polymer coupler latexes was mixed with 100 g of a silver iodobromide emulsion containing 7 g of a gelatin (the amount of the latex was such that the amount of the coupler unit was $5.6\times10^{-2}$ moles per mole of silver in the emulsion), to which 8 ml of a 4% acetone solution of 2-hydroxy-4,6-dichloro-s-triazone sodium salt was added. The pH of the mixture was adjusted to 6.7 and the mixture was coated on a cellulose triacetate film having a subbing layer in an amount of silver coated of $1.2\times10^{-3}$ mol/m$^2$, to prepare Samples 1, 2 and 3.

These films were exposed stepwise for sensitometry and then subjected to the following color development processing.

| Color Development Processing Step (38° C.) | Time (min) |
|---|---|
| 1. First development | 3 |
| 2. Washing with water | 1 |
| 3. Reversal | 2 |
| 4. Color development | 6 |
| 5. Control | 2 |
| 6. Bleaching | 6 |
| 7. Fixing | 4 |
| 8. Washing with water | 4 |
| 9. Stabilizing | 1 |
| 10. Drying | |

The processing solutions used in the color development processing had the following compositions:

| | |
|---|---|
| First Development Solution | |
| Water | 800 ml |
| Sodium Tetrapolyphosphate | 2.0 g |
| Sodium Hydrogensulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 g |
| Sodium Thiocyanate | 1.4 g |
| Water to make | 1 liter |
| Reversal Solution | |
| Water | 800 ml |
| Hexasodium Nitrilo-N,N,N—trimethylene Phosphonate | 3.0 g |
| Stannous Chloride Dihydrate | 1.0 g |
| Sodium Hydroxide | 8.0 g |
| Glacial Acetic Acid | 15.0 ml |
| Water to make | 1 liter |
| Color Development Solution | |
| Water | 800 ml |
| Sodium Tetrapolyphosphate | 2.0 g |
| Benzyl Alcohol | 5.0 ml |
| Sodium Sulfite | 7.5 g |
| Sodium Tertiary Phosphate (12 hydrate) | 36.0 g |
| Potassium Bromide | 1.0 g |
| Potassium Iodide | 90.0 mg |
| Sodium Hydroxide | 3.0 g |
| Citrazic Acid | 1.5 g |
| 4-Amino-3-methyl-N—ethyl-β-hydroxyethyl aniline Sesquisulfate Monohydrate | 11.0 g |
| Ethylenediamine | 3.0 g |
| Water to make | 1 liter |
| Control Solution | |
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1 liter |
| Bleaching Solution | |
| Water | 800 ml |
| Sodium Ethylenediaminetetraacetate Dihydrate | 2.0 g |
| Ammonium Iron (II) Ethylenediaminetetraacetate Dihydrate | 120.0 g |
| Potassium Bromide | 100.0 g |

-continued

| | |
|---|---|
| Water to make | 1 liter |
| Fixing Solution | |
| Water | 800 ml |
| Ammonium Thiosulfate | 80.0 g |
| Sodium Sulfite | 5.0 g |
| Sodium Hydrogensulfite | 5.0 g |
| Water to make | 1 liter |
| Stabilizing Bath | |
| Water | 800 ml |
| Formalin (37 wt %) | 5.0 ml |
| Fuji Driwel (surface active agent produced by Fuji Photo Film Co., Ltd.) | 5.0 ml |
| Water to make | 1 liter |

The photographic properties thus-obtained are shown in Table 1 below.

Further, each sample was exposed stepwise and subjected to the same color development processing as described above. Then the granularity (RMS values) of each sample was measured with green light in areas having a color density of 0.5 and 1.0 respectively and the results thus obtained are also shown in Table 1 below. The granularity was determined according to a conventional RMS (Root Mean Square) method and shown with the value obtained by magnifying 100 times the standard deviation of change in density measured when scanning using a microdensitometer having a round scanning diameter of 4.8μ. The smaller the value, the better the granularity.

Furthermore, each sample was contacted with formaldehyde vapour of (A) 0 ppm or (B) 20 ppm at 45° C. and 70% relative humidity for 12 hours. Then the sample was exposed stepwise for sensitometry and subjected to the same color development processing as described above. The formalin resistivity, i.e., a ratio of the maximum density.

$$\frac{(Dmax)B}{(Dmax)A}$$

thus obtained is also shown in Table 1 below.

TABLE 1

| Sample | Latex Used | Color Forming Property: Fog | Color Forming Property: Maximum Color Density | Granularity (RMS × 100) $D_{0.5}$ | Granularity (RMS × 100) $D_{1.0}$ | Formalin Resistivity $\frac{(Dmax)B}{(Dmax)A}\times100$ % |
|---|---|---|---|---|---|---|
| 1 (Present Invention) | (I') | 0.05 | 2.76 | 1.2 | 2.1 | 99 |
| 2 (Present Invention) | (II') | 0.05 | 2.51 | 1.1 | 2.0 | 100 |
| 3 (Comparison) | (a') | 0.05 | 1.95 | 1.7 | 2.8 | 51 |

From the results shown in Table 1 above it is apparent that the two-equivalent magenta polymer coupler latexes according to the present invention are superior to the magenta polymer coupler latex used for comparison, with respect to the color forming properties, the granularity, and the formalin resistivity.

The oleophilic polymer coupler for comparison employed has the following composition.

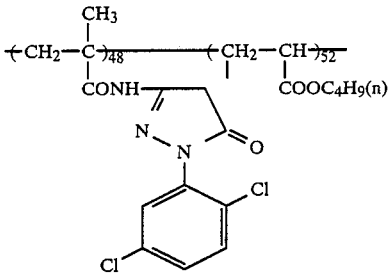

(The polymer coupler (a) can be synthesized according to Synthesis Method I)

EXAMPLE 2

Sample 4

On a cellulose triacetate film support were coated layers having the compositions set forth below to prepare a multilayer color photographic light-sensitive material (Sample 4).

First layer: Antihalation Layer (AHL)

A gelatin layer containing black colloidal silver

Second Layer: Intermediate Layer (ML)

A gelatin layer containing a dispersion of 2,5-di-tert-octylhydroquinone

Third Layer: First Red-Sensitive Emulsion Layer ($RL_1$)

A silver iodobromide emulsion (silver iodide content: 5 mol%, average grain size: 0.5μ), silver coated amount: 1.90 g/m$^2$

| | |
|---|---|
| Sensitizing Dye I | $6 \times 10^{-4}$ mol per mol of silver |
| Sensitizing Dye II | $1.5 \times 10^{-4}$ mol per mol of silver |
| Coupler C-2 | 0.04 mol per mol of silver |
| Coupler C-3 | 0.003 mol per mol of silver |
| Coupler C-4 | 0.0006 mol per mol of silver |

Fourth Layer: Second Red-Sensitive Emulsion Layer ($RL_2$)

A silver iodobromide emulsion (silver iodide content: 10 mol%, average grain size: 1.5μ), silver coated amount: 1.60 g/m$^2$

| | |
|---|---|
| Sensitizing Dye I | $2.5 \times 10^{-4}$ mol per mol of silver |
| Sensitizing Dye II | $1.0 \times 10^{-4}$ mol per mol of silver |
| Coupler C-5 | 0.02 mol per mol of silver |
| Coupler C-3 | 0.0016 mol per mol of silver |

Fifth Layer: Intermediate Layer (ML)

Same as the Second Layer

Sixth Layer: First Green-Sensitive Emulsion Layer ($GL_1$)

A silver iodobromide emulsion (silver iodide content: 4 mol%, average grain size: 0.45μ), silver coated amount: 1.6 g/m$^2$

| | |
|---|---|
| Sensitizing Dye III | $3 \times 10^{-4}$ mol per mol of silver |
| Sensitizing Dye IV | $1 \times 10^{-4}$ mol per mol of silver |
| Coupler C-6 | 0.05 mol per mol of silver |
| Coupler C-7 | 0.008 mol per mol of silver |
| Coupler C-4 | 0.0015 mol per mol of silver |

Seventh Layer: Second Green-Sensitive Emulsion Layer ($GL_2$)

A silver iodobromide emulsion (silver iodide content: 8 mol%, average grain size: 1.4μ), silver coated amount: 1.8 g/m$^2$

| | |
|---|---|
| Sensitizing Dye III | $2.5 \times 10^{-4}$ mol per mol of silver |
| Sensitizing Dye IV | $0.8 \times 10^{-4}$ mol per mol of silver |
| Coupler C-7 | 0.003 mol per mol of silver |
| Comparison Coupler C-1 | 0.017 mol per mol of silver |

Eight Layer: Yellow Filter Layer (YFL)

A gelatin layer containing yellow colloidal silver and a dispersion of 2,5-di-tert-octylhydroquinone Ninth Layer: First Blue-Sensitive Emulsion Layer ($BL_1$)

A silver iodobromide emulsion (silver iodide content: 6 mol%, average grain size: 0.5μ), silver coated amount: 1.0 g/m$^2$

| | |
|---|---|
| Coupler C-8 | 0.25 mol per mol of silver |
| Coupler C-4 | 0.015 mol per mol of silver |

Tenth Layer: Second Blue-Sensitive Emulsion Layer ($BL_2$)

A silver iodobromide emulsion (silver iodide content: 8 mol%, average grain size: 1.0μ), silver coated amount: 1.1 g/m$^2$

| | |
|---|---|
| Coupler C-8 | 0.06 mol per mol of silver |

Eleventh Layer: Protective Layer (PL)

A gelatin layer containing polymethyl methacrylate particles (having a diameter of 1.5μ)

A gelatin hardener H-1 and a surface active agent were incorporated into each of the layers in addition to the above-described components.

The sample thus prepared was designated Sample 4.

Samples 5 and 6

Samples 5 and 6 were prepared in the same manner as described for Sample 4 except using an equimolar coupler unit amount of Oleophilic Polymer Couplers (I) and (II) according to the present invention in place of Coupler C-1 in $GL_2$ of Sample 4, respectively.

Samples 4, 5 and 6 were exposed to white light for sensitometry and for granularity measurement and then subjected to the following color development processing.

| Color Development Processing Step | Time | Temperature (°C.) |
|---|---|---|
| 1. Color development | 3 min 15 sec | 38 |
| 2. Bleaching | 6 min 30 sec | " |
| 3. Washing with water | 2 min | " |
| 4. Fixing | 4 min | " |
| 5. Washing with water | 4 min | " |
| 6. Stabilizing | 1 min | " |

The processing solutions used in the color development processing had the following compositions:

| Color Development Solution | |
|---|---|
| Water | 800 ml |
| 4-(N—Ethyl-N—hydroxyethyl)amino-2-methylaniline Sulfate | 5 g |
| Sodium Sulfite | 5 g |

-continued

| | |
|---|---|
| Hydroxylamine Sulfate | 2 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 liter (pH 10.1) |
| Bleaching Solution | |
| Water | 800 ml |
| Iron (III) Ammonium Ethylenediamine-tetraacetate | 100 g |
| Disodium Ethylenediaminetetraacetate | 10 g |
| Potassium Bromide | 150 g |
| Acetic Acid | 10 g |
| Water to make | 1 liter (pH 6.0) |
| Fixing Solution | |
| Water | 800 ml |
| Ammonium Thiosulfate | 150 g |
| Sodium Sulfite | 10 g |
| Sodium Hydrogensulfite | 2.5 g |
| Water to make | 1 liter (pH 6.0) |
| Stabilizing Solution | |
| Water | 800 ml |
| Formalin (37 wt %) | 5 ml |
| Fuji Driwel | 3 ml |
| Water to make | 1 liter |

The photographic properties and the granularity thus-obtained are shown in Table 2 below.

TABLE 2

| Sample | Coupler | Relative Sensitivity*1 | Granularity (RMS × 100) |
|---|---|---|---|
| 4 (Comparison) | C-1 | 100 | 2.6 |
| 5 (Present Invention) | Oleophilic Polymer Coupler (I) | 106 | 1.3 |
| 6 (Present Invention) | Oleophilic Polymer Coupler (II) | 98 | 1.2 |

*1Relative value of a reciprocal of the exposure amount required for obtaining an optical density of fog value + 0.2, and the sensitivity of Sample 4 is taken as 100.

From the results shown in Table 2 above it is apparent that Samples 5 and 6 prepared by using Oleophilic Polymer Coupler (I) and (II) according to the present invention, respectively, exhibit remarkably improved granularity in comparison with Sample 4 using Coupler C-1 for comparison while having the sensitivity in the substantially same level.

The compounds employed for the preparation of Samples 4, 5 and 6 are set forth below.

Sensitizing Dye I: Pyridinium salt of anhydro-5,5'-dichloro3,3'-di(γ-sulfoprpyl)-9-ethylthiacarbocyanine hydroxide Sensitizing Dye II: Triethylamine salt of anhydro-9-ethyl-3,3'-di(γ-sulfopropyl)-4,5,4',5'-dibenzothiacarbocyanine hydroxide.

Sensitizing Dye III: Sodium salt of anhydro-9-ethyl-5,5'-dichloro-3,3'-di(γ-sulfopropyl)oxacarbocyanine Sensitizing Dye IV: Sodium salt of anhydro-5,6,5',6'-tetrachloro-1,1'-diethyl-3,3'-di{β-[β-(γ-sulfopropoxy)ethoxy]ethyl imidazolocarbocyanine hydroxide

C - 1

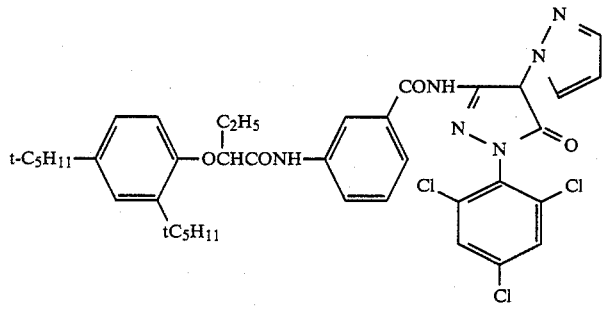

C - 2

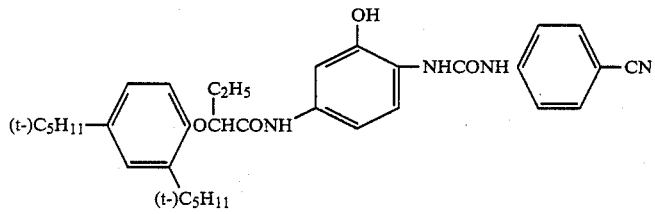

C - 3

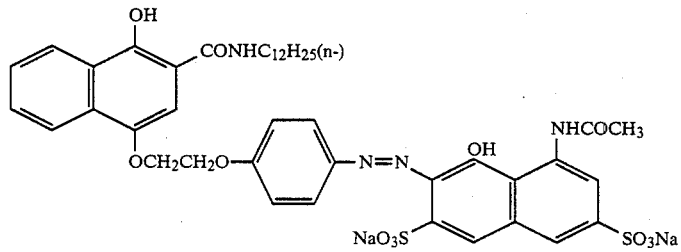

-continued

C - 4

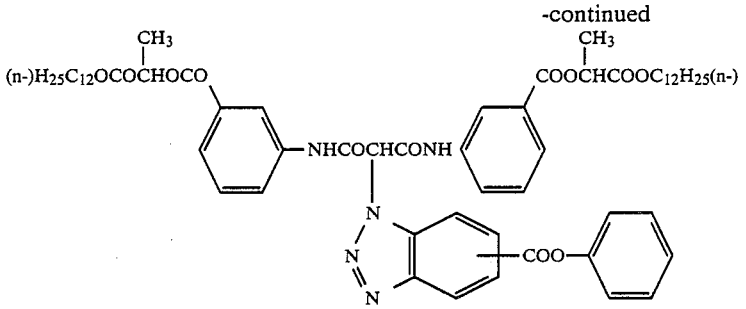

C - 5

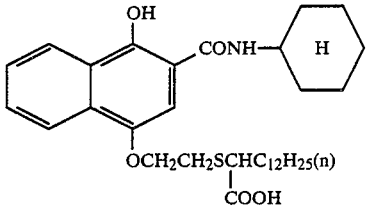

C - 6

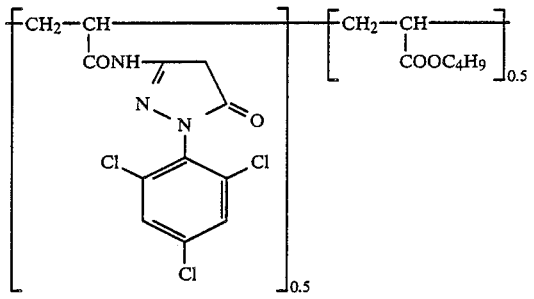

C - 7

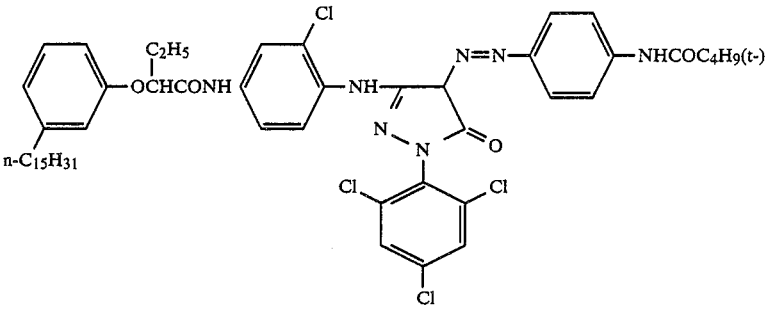

C - 8

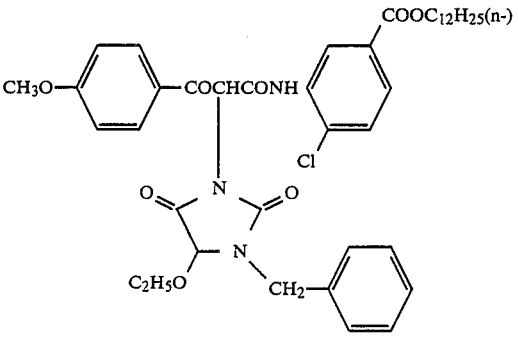

H - 1
1,3-Divinylsulfonyl-2-propanol

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a magenta color image forming polymer coupler latex which is capable of forming a dye upon coupling with an oxidation product of an aromatic primary amine developing agent and which is a homopolymer or copolymer having a repeating unit derived from a monomer represented by formula (I)

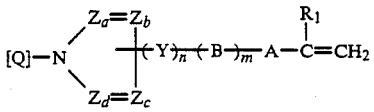

(I)

wherein [Q] represents a magenta color image forming coupler residue wherein the coupling active position is substituted for the remainder of the monomer molecule of formula (I); Za, Zb, Zc and Zd, which are the same or different, each represents a methine group, a substituted methine group, or —N=; $R_1$ represents a hydrogen atom, a lower alkyl group having from 1 to 4 carbon atoms or a chlorine atom; A represents —NHCO—, —OCO—, or a phenylene group; Y represents —O—, —NH—, —S—, —SO—, —$SO_2$—, —CONH—, —COO—, —NHCO—, or —NHCONH—; B represents an unsubstituted or substituted straight or branched chain alkylene group, an unsubstituted or substituted aralkylene group or an unsubstituted or substituted phenylene group; m represents 0 or 1; and n represents 0 or 1, provided that when n represents 1, m represents 1 and when n represents 0, m represents 0 or 1.

2. A silver halide color photographic light-sensitive material as in claim 1, wherein the magenta color image forming coupler residue represented by [Q] is a pyrazolone residue, a pyrazolotriazole residue, or an imidazopyrazole residue.

3. A silver halide color photographic light-sensitive material as in claim 1, wherein the magenta color image forming coupler residue represented by [Q] is represented by formula (II)

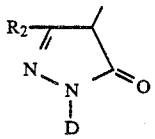

(II)

wherein D represents an alkyl group, a substituted alkyl group, an aryl group or a substituted aryl group; and $R_2$ represents an unsubstituted or substituted anilino group, an unsubstituted or substituted acylamino group, or an unsubstituted or substituted ureido group.

4. A silver halide color photographic light-sensitive material as in claim 3, wherein a substituent for the substituted alkyl group represented by D is a halogen atom, a cyano group, a benzyl group.

5. A silver halide color photographic light-sensitive material as in claim 3, wherein a substituent for the substituted aryl group represented by D is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

6. A silver halide color photographic light-sensitive material as in claim 3, wherein a substituent for the substituted anilino group, the substituted acylamino group or the substituted ureido group represented by $R_2$ is a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, a sulfo group, a hydroxy group, or a trichloromethyl group.

7. A silver halide color photographic light-sensitive material as in claim 1, wherein the magenta color image forming coupler residue represented by [Q] is represented by formula (III), (IV), (V), (VI), (VII), or (VIII)

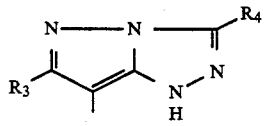

(III)

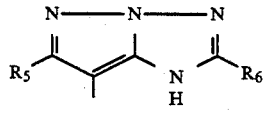

(IV)

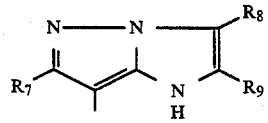

(V)

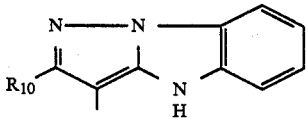

(VI)

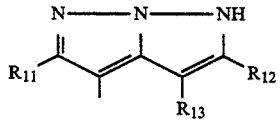

(VII)

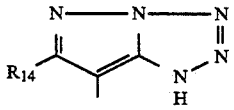

(VIII)

wherein $R_3$, $R_4$, $R_5$, $R_6$, $R_7$, $R_8$, $R_9$, $R_{10}$, $R_{11}$, $R_{12}$, $R_{13}$, and $R_{14}$ each represents a hydrogen atom, a hydroxy group, an alkyl group, an aryl group, a heterocyclic group, an alkylamino group, an acylamino group, an anilino group, an alkoxycarbonyl group, an alkylcarbonyl group, an arylcarbonyl group, an alkylthio group, an arylthio group, a carbamoyl group, a sulfamoyl group, a sulfonamido group or substituted groups thereof.

8. A silver halide color photographic light-sensitive material as in claim 1, wherein the alkylene group represented by B is an alkylene group having from 1 to 10 carbon atoms.

9. A silver halide color photographic light-sensitive material as in claim 1, wherein a substituent for the substituted alkylene group, the substituted aralkylene group, or the substituted phenylene group represented by B is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, or a sulfonyl group.

10. A silver halide color photographic light-sensitive material as in claim 1, wherein a substituent for the substituted methine group represented by Za, Zb, Zc, or Zd is a straight chain or branched chain alkyl group having from 1 to 10 carbon atoms, a cycloalkyl group, an aralkyl group, an aryl group, a heterocyclic group, an alkoxycarbonyl group, an aryloxycarbonyl group, an aralkyloxycarbonyl group, an alkoxy group, an aryloxy group, an alkylthio group, a carboxy group, an acylamino group, a diacylamino group, and N-alkylacylamino group, an N-arylacylamino group, a ureido group, a thioureido group, an alkyloxycarbonylamino group, an aryloxycarbonylamino group, an anilino group, an alkylamino group, a cycloamino group, an alkylcarbonyl group, an arylcarbonyl group, a sulfonamido group, a carbamoyl group, a sulfamoyl group, a cyano group, an acyloxy group, a sulfonyloxy group, an alkylsulfonyl group, an arylsulfonyl group, a halogen atom, a sulfo group, or a nitro group.

11. A silver halide color photographic light-sensitive material as in claim 1, wherein the heterocyclic group represented by

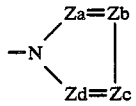

is a pyrazolyl group, an imidazolyl group, a triazolyl group, or a tertrazolyl group.

12. A silver halide color photographic light-sensitive material as in claim 1, wherein the copolymer is a copolymer of two or more of the monomer couplers represented by formula (I).

13. A silver halide color photographic light-sensitive material as in claim 1, wherein the copolymer comprises of at least one of the monomer couplers represented by formula (I) and at least one of non-color forming ethylenic monomers which do not couple with the oxidation product of an aromatic primary amine developing agent.

14. A silver halide color photographic light-sensitive material as in claim 13, wherein the non-color forming monomer is selected from an acrylic acid, an ester of an acrylic acid, an amide of an acrylic acid, a vinyl ester, an acrylonitrile, a methacrylonitrile, an aromatic vinyl compound, itaconic acid, citraconic acid, crotonic acid, vinylidene chloride, a vinyl alkyl ether, an ester of maleic acid, N-vinyl-2-pyroolidone, N-vinyl pyridine, or 2- or 4-vinyl pyridine.

15. A silver halide color photographic light-sensitive material as in claim 1, wherein the amount of the color forming portion in the polymer latex is from 5% to 80% by weight.

16. A silver halide color photographic light-sensitive material as in claim 1, wherein the gram number of the polymer latex containing 1 mol of coupler monomer is from 250 to 4,000.

17. A silver halide color photographic light sensitive material as in claim 1, wherein two substituents of Za, Zb, Zc and Zd form a condensed ring with the nitrogencontaining ring formed with the N atom, Za, Zb, Zc and Zd.

18. A silver halide color photographic light sensitive material as in claim 17, wherein the condensed ring is a ring selected from the group consisting of benzimidazolyl and benztriazolyl.

19. A silver halide color photographic light sensitive material as in claim 17, wherein the polymer coupler has a polymerization degree of from 10,000 to 150,000.

* * * * *